United States Patent [19]

Cremer

[11] 4,250,731

[45] Feb. 17, 1981

[54] METHOD FOR PRODUCING TRIMMING DIES

[75] Inventor: Kurt H. L. Cremer, Ratingen, Fed. Rep. of Germany

[73] Assignee: Sack & Kiesselbach Maschinenfabrik, GmbH, Duesseldorf-Rath, Fed. Rep. of Germany

[21] Appl. No.: 951,634

[22] Filed: Oct. 16, 1978

[51] Int. Cl.³ ..... B21D 22/00

[52] U.S. Cl. ..... 72/354; 72/359; 72/370

[58] Field of Search ..... 72/352, 354, 359, 370, 72/427, 344

[56] References Cited

U.S. PATENT DOCUMENTS

| | | | |
|---|---|---|---|
| 2,168,300 | 8/1939 | Lemming | 72/370 X |
| 2,621,344 | 12/1952 | Friedman | 72/354 X |
| 2,627,652 | 2/1953 | Schweller | 72/359 X |
| 3,138,257 | 6/1964 | Anderson | 72/354 |
| 3,434,326 | 3/1969 | Serret | 72/354 |
| 3,455,138 | 7/1969 | Zopf | 72/352 X |

FOREIGN PATENT DOCUMENTS

| | | | |
|---|---|---|---|
| 2145357 | 2/1973 | France | 72/354 |

*Primary Examiner*—Leon Gilden

*Attorney, Agent, or Firm*—John J. Dennemeyer

[57] ABSTRACT

A method of producing trimming dies with a conical many-sided bore for use in a screw trimming press. A trimming die blank is produced with an outer diameter corresponding to the inner diameter of a cup-shaped holder and to a finished height and with a cylindrical inner bore. The many-sided bore is produced by cold deformation of the inner diameter by means of a many-sided punch introduced to a limited extent into the inner bore while preserving the outer diameter. Apparatus for carrying out the method includes a holder for the trimming die blank. A spacer ring located below the blank and resting on the base of the holder in use, a guide sleeve and a many-sided punch guidable by said guide sleeve and having a length exceeding that of the guide sleeve by an amount corresponding to a predetermined insertion depth of the punch in the blank. The base of the holder has an ejector bush with an ejector mandrel.

2 Claims, 4 Drawing Figures

METHOD FOR PRODUCING TRIMMING DIES

Figure 1:
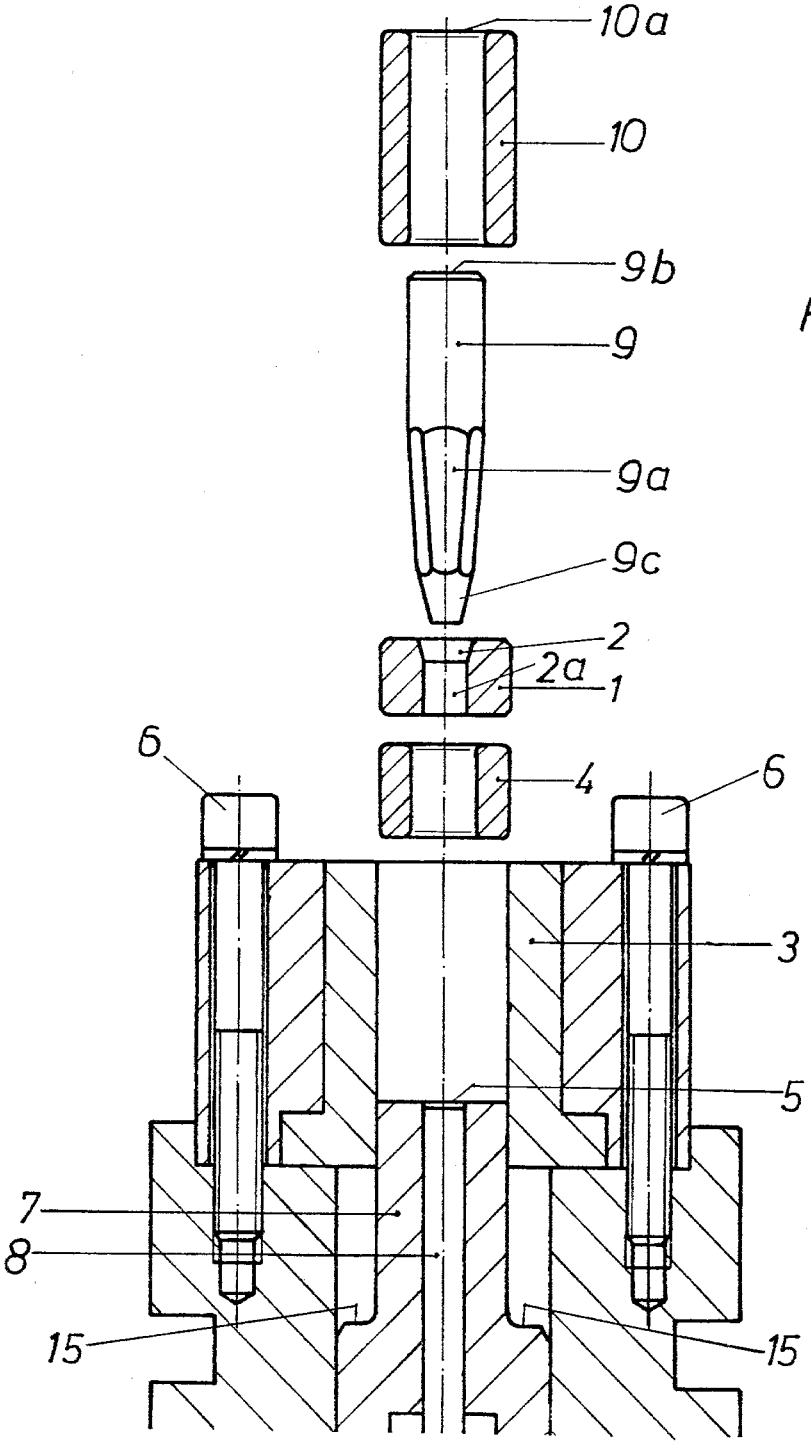

The invention relates to a method for producing trimming dies with a conical many-sided bore for use in a screw trimming press with a cup-shaped holder in the die support, for calibrating the width across flats of screws.

One possibility for producing trimming dies is known (French Pat. No. 2 145 357). In this case, a cylindrical blank, having a conical axial bore, is inserted in a holder of a press. The diameter of the lower opening of the conical bore is chosen to be equal to or greater than the diameter at the angle of the screw head produced by means of the die. The holder itself has an outer cylindrical bore portion, which passes into a conical bore portion, whose conicity is substantially equal to that of the punch. An inner cylindrical bore portion follows the conical bore portion.

As soon as the blank is located in the outer cylindrical bore portion of the holder, a pyramidal punch with a hexagonal section is introduced into the conical bore in the blank. The cylindrical shaft of the punch is guided in a ring. During the pressing operation, the ring whose diameter is not greater than that of the outer cylindrical bore portion in the holder, bears against the upper surface of the blank, whereas the punch engages in the conical bore in the blank. Due to further actuation of the ring and punch, the hexagonal head is formed in the blank, in which case the cylindrical blank becomes distorted in the conical bore portion of the holder, under the pressing force, and thus obtains a conical external shape caused by the flow of material. As the pressing operation continues, material also flows on the lower end face of the blank into the inner cylindrical bore portion in the holder adjoining the conical bore, so that in the final position of the punch, in addiotion to the conical outer shape, the blank is also provided on one end face with a cylindrical projection.

After the punch and ring have once more been removed, the die can be removed by rotating the holder. However, before a die produced according to this known method can be used in the production of screws, it is absolutely necessary, using a further machining process, for example grinding or turning, to remove the cylindrical projection on one end face of the blank, and also to remove the cone, in order to obtain a utilizable die of desired dimensions with a cylindrical outer diameter. That is, the external configuration of the die must be changed from conical to cylindrical, through machining or a like process. This finishing operation is compulsory, since the corresponding holder for the die is constructed in a clylindrical manner in a screw press.

The object of the invention is to eliminate the said drawbacks when producing a trimming die for the manufacture of screws with a polygonal head and to obtain dies with the desired dimensions without the need for futher substantial finishing operations.

This object is fulfilled according to the invention due to the fact that the blank of the trimming dies is produced with an outer cylindrical diameter corresponding to the inner diameter of the cupshaped holder, with the blank having a finished size as regards its height and having a cylindrical inner bore, the many-sided bore being produced within the blank by cold deformation of the blank's inner diameter by means of a many-sided pressure punch introduced to a limited extent into the inner bore, whilst preserving the blank's outer diameter.

On using this method together with an apparatus according to the invention, it is now possible to obtain a trimming die, which without any further additional machining—apart from the removal of a slight burr, which forms on the lower end face at the edge of the bore when the punch is removed—can be immediately used for production, since the die retains an exact predetermined cylindrical outer diameter and can have exact tolerances as regards height or length. Thus, compression of the material occurs due to the widening of the bore in the blank, with simultaneous fixing in the holder between the punch or guide sleeve and the spacer ring and the ejector mandrel forming the base of the holder, which has a positive effect not least on the tool life of the trimming die. On the other hand, the finished die can be ejected without manual intervention, by actuating the ejector mandrel.

Figure 2:
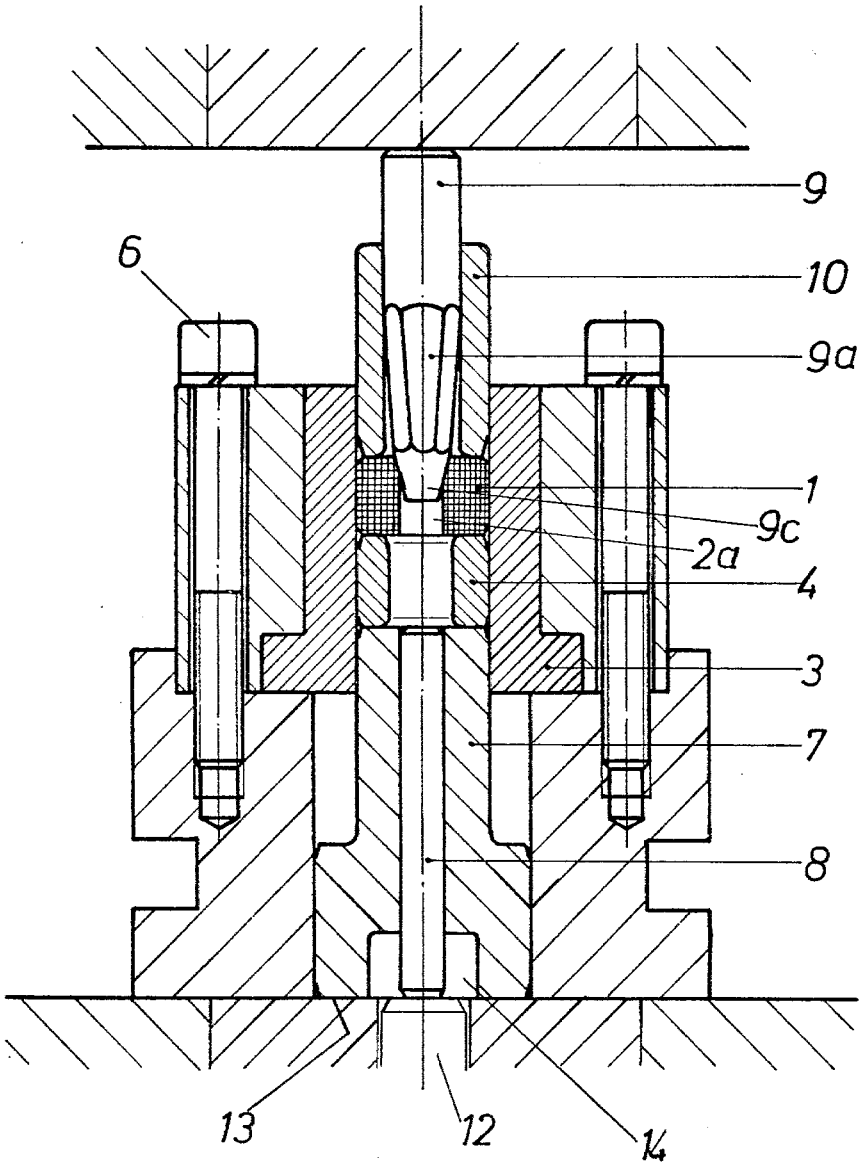
Figure 3:
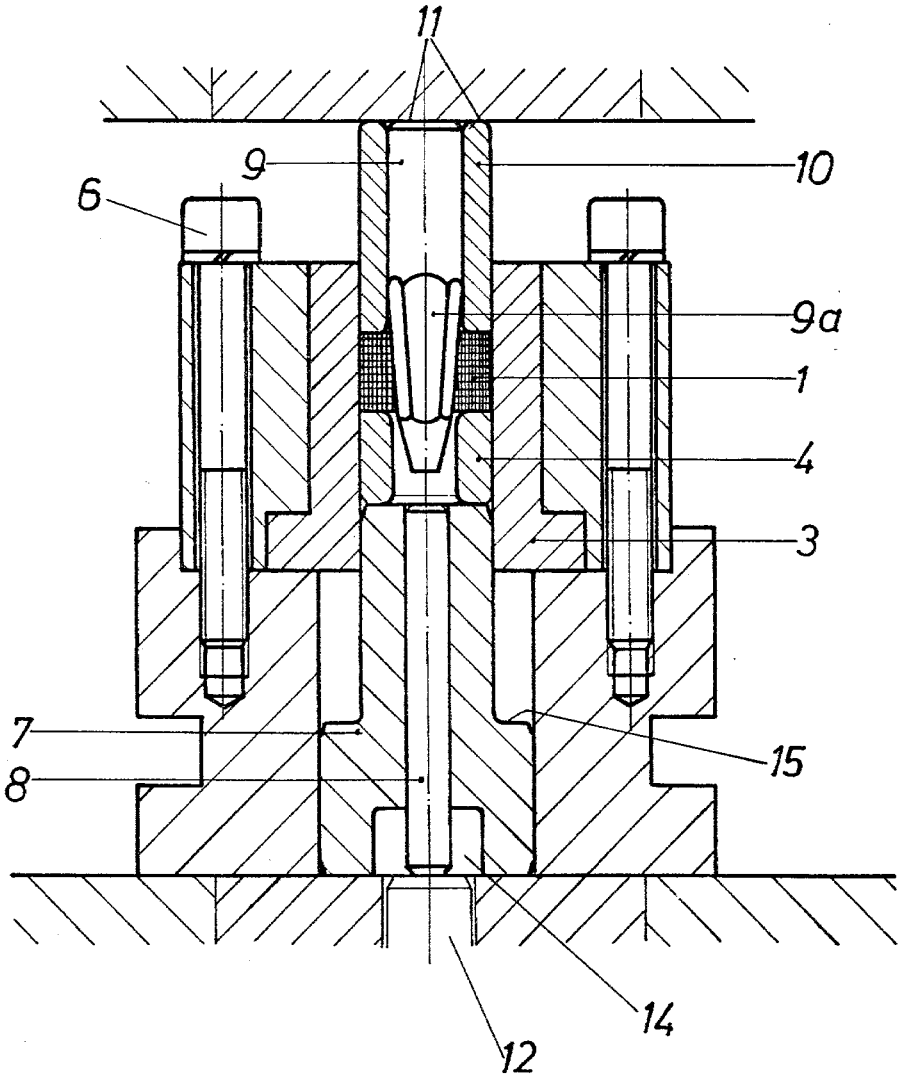
Figure 4:
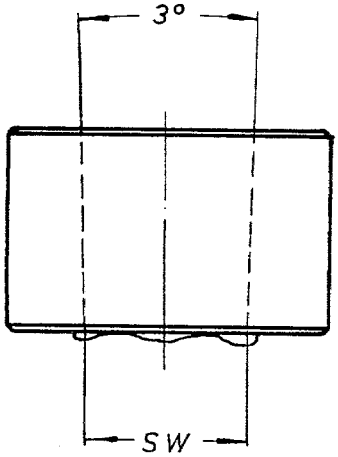

One embodiment of an apparatus for carrying out the method according to the invention is illustrated in the drawings wherein FIG. 1 is a vertical sectional view showing the various parts necessary for carrying out the present method, FIG. 2 is a vertical sectional view with the various parts of FIG. 1 shown in the initial position, FIG. 3 is a vertical section showing to FIG. 2, but with the punch in the final position; and FIG. 4 shows a finished pressed trimming die, made according to the invention.

As can be seen from FIG. 1, the starting material for the trimming die to be produced is a blank 1, which is constructed as a cylindrical ring with a short conical bore 2 and a cylindrical bore 2*a*. The diameter of the cylindrical bore 2*a* is smaller than the dimension of the screw head, which is to be produced with the trimming die. To form the die with a many-sided bore, the blank 1 is inserted in a cylindrical holder 3 and comes to rest on a spacer ring 4 located below the blank, which ring is supported on the base 5 of the holder 3. The holder is secured to the press by means of screws 6, and includes an ejector bush 7 with an ejector mandrel 8 forming the base 5 and projecting into the bore of the holder. A conical punch 9, in this case with hexagonal sections 9*a*, is inserted into the bore of the blank 1, in which case the short conical portion of the bore 2 in the blank 1 serves for a better introduction. A guide sleeve 10 which serves for guiding the punch 9 fits on the cylindrical part of the punch 9. The length of the many-sided punch 9 exceeds the length of the guide sleeve 10 such that when the punch has been driven into the inner bore 2, 2*a* of the blank 1 until its free end face 9*b* closes-off the upper annular surface 10*a* of the guide sleeve 10, the many-sided inner bore is completed. It is naturally within the framework of the invention that the penetration depth of the punch into the inner bore of the blank can also be determined by limiting the stroke of the press.

According to FIG. 2, the spacer ring 4, the blank 1 and part of the guide sleeve 10 are located in the bore in the holder 3, in which case the punch 9 already projects by its point 9*c* into the bore 2*a*, guided by the short conical bore 2 of the blank 1. In this position, during the subsequent working stroke, the punch solely covers a distance until the end face 9*b* of the punch 9 and the end face 10*a* of the guide sleeve 10 form a common surface 11 (FIG. 3) and the finished size of the many-sided inner bore of the blank and thus of the die is reached. The diameter of the cylindrical bore in the holder 3 is equal to the diameters of the spacer ring, of the blank, of the ejector bush and of the guide sleeve, due to which, at the time of pressing, the predetermined outer diameter of the cylindrical blank or of the trimming die is maintained exactly.

The final position of the punch 9 is illustrated in FIG. 3. Due to axial pressure in the vertical direction on the punch (or if the press stroke is limited, due to simultaneous axial pressure on the punch 9 and guide sleeve 10), the punch 9 is pushed through the bore 2, 2*a*, thus producing an enlargement of the inner bore in the blank 1 and compression of the material and thus of the many-sided faces of the blank. The radial forces which occur and are distributed uniformly around the punch at the time of compression of the material, have no harmful effect.

When the pressing operation is completed, the press is retracted or the press plates of the latter are moved apart and the punch 9 as well as the guide sleeve 10 are released. Then, an ejection punch 12 provided in the press is actuated, which enters a blind bore 14 located on the lower support surface 13 of the ejector bush 7 and pushes the ejector mandrel 8 towards the punch 9. The seat between the conical part 9*a* of the punch 9 provided with polygonal sections and the pressed die is loosened. Upon further actuation of the ejector punch 12, the ejector bush 7 then acts against the spacer ring 4 and thus against the finished pressed blank 1. The ejection stroke of the ejector bush 7 and of the ejector mandrel 8 pre-set by means of the depth of the blind bore 14 is thus limited by the stop collar 15 of the ejector bush 7. As soon as the stop collar 15 comes to bear against the holder 3, the ejection process is completed. Only the ejector bush 7 with the ejector mandrel 8 and the spacer ring 4 located thereon are then located in the bore of the holder 3. The externally cylindrical die produced and ejected in this way can be seen in FIG. 4. It is easy to see that apart from slight finishing when removing the burr on the underside of the inner bore, there is no need for further machining of the die and the latter can be used immediately.

I claim:

1. The method for producing a cylindrical trimming die having a conical many-sided internal bore extending therethrough, for use in a screw trimming press having a cup-shaped cylindrical holder of a given inner diameter within which said trimming die is receivable, said method including the steps of:

preparing by machining a cylindrical blank having a uniform external diameter corresponding to the inner diameter of said cup-shaped cylindrical holder and an inner bore extending therethrough, said inner bore being uniformly cylindrical for at least the majority of the length thereof, and the height and external diameter of said blank corresponding essentially to the desired finished height and diameter thereof;

placing said prepared cylindrical blank into a cylindrical bore provided in a holder mounted on a press, said cylindrical bore having a uniform internal diameter substantially the same as the uniform external diameter of said blank, and said blank being so positioned within said cylindrical bore that the sidewall of said cylindrical bore engages and confines said cylindrical blank over the full height thereof;

introducing one end of a many-sided punch into said inner bore of said cylindrical blank;

placing a cylindrical guide sleeve about the other end of said punch, said guide sleeve being disposed between said cylindrical blank and a movable portion of said press which is arranged to engage said punch and the outer end of said guide sleeve, the inner end of said guide sleeve being engaged with said cylindrical blank, and the length of said punch exceeding the height of said guide sleeve by an amount corresponding to a desired predetermined insertion depth of the punch into said blank; and pressing said punch into said inner bore of said cylindrical blank while holding said blank stationary against movement axially of said cylindrical bore of said holder, until said guide sleeve is engaged by both said cylindrical blank and said movable portion of said press, whereby to produce within said blank a many-sided internal bore by cold deformation while the initial, finished external height and diameter of said blank are essentially preserved.

2. The method as recited in claim 4, including the further steps of:

withdrawing said many-sided punch from said cylindrical blank, after formation of said many-sided internal bore; and removing the completed trimming die from said cylindrical bore by moving an ejector means through said cylindrical bore in a direction toward said punch.

* * * * *